US008499773B2

(12) United States Patent
Marone et al.

(10) Patent No.: US 8,499,773 B2
(45) Date of Patent: Aug. 6, 2013

(54) DEVICE FOR DISPENSING A WASHING AGENT IN A WASHING MACHINE, PARTICULARLY A DISHWASHER

(75) Inventors: Giuseppe Marone, Nichelino (IT); Angelo Canova, Villarbasse (IT)

(73) Assignee: Elbi International S.p.A., Torino (IT)

( * ) Notice: Subject to any disclaimer, the term of this patent is extended or adjusted under 35 U.S.C. 154(b) by 1218 days.

(21) Appl. No.: 12/295,838

(22) PCT Filed: Apr. 5, 2007

(86) PCT No.: PCT/IB2007/051222
§ 371 (c)(1),
(2), (4) Date: Feb. 4, 2009

(87) PCT Pub. No.: WO2007/116354
PCT Pub. Date: Oct. 18, 2007

(65) Prior Publication Data

US 2009/0288687 A1 Nov. 26, 2009

(30) Foreign Application Priority Data

Apr. 7, 2006 (IT) ..... TO2006A0259

(51) Int. Cl.
*B08B 3/00* (2006.01)
*B67D 3/00* (2006.01)

(52) U.S. Cl.
USPC ..... 134/93; 134/56 D; 134/57 D; 134/58 D

(58) Field of Classification Search
USPC ..... 134/56 D, 57 D, 58 D, 93; 222/556
See application file for complete search history.

(56) References Cited

U.S. PATENT DOCUMENTS

| | | | | |
|---|---|---|---|---|
| 5,884,821 | A | 3/1999 | Wilhelmstaetter et al. | |
| 6,622,896 | B2 * | 9/2003 | Hegeman et al. | 222/651 |
| 2003/0188768 | A1 * | 10/2003 | Cerruti et al. | 134/57 D |
| 2004/0020517 | A1 * | 2/2004 | Cerruti et al. | 134/25.2 |
| 2004/0069325 | A1 * | 4/2004 | Cerruti et al. | 134/25.2 |
| 2005/0115595 | A1 * | 6/2005 | Cerruti et al. | 134/93 |

FOREIGN PATENT DOCUMENTS

| | | | |
|---|---|---|---|
| DE | 102 49 793 | A1 | 5/2004 |
| EP | 0 780 087 | A2 | 6/1997 |
| EP | 1 723 893 | A2 | 11/2006 |
| WO | 03/045214 | A2 | 6/2003 |

OTHER PUBLICATIONS

Machine Translation of DE 10249793 to Jans et al., May 2004.*

* cited by examiner

*Primary Examiner* — Michael Barr
*Assistant Examiner* — Benjamin L Osterhout
(74) *Attorney, Agent, or Firm* — Sughrue Mion, PLLC

(57) ABSTRACT

The device (1) comprises:
- a body (2) in which is formed a receptacle (3) having a mouth (4) and intended to receive a quantity of washing agent,
- a cover (5) connected to the body (2) and movable between a position in which the mouth (4) of the said receptacle (3) is closed and a position in which the mouth is open, and
- a return spring tending to move the cover (5) towards the open position.

The cover (5) has a first portion (5*a*) hinged to the body (2) about a first axis (7) parallel to the mouth (4) of the receptacle (3) and translatable along guides (6) provided in the body (2), and a second portion (5*b*) connected to a crank element (8) by hinging about a second axis (9) parallel to the first axis (7). The crank element (8) is, in turn, hinged to the body (2) about a third, fixed axis (10) which is parallel to the first and second axes (7, 9).

5 Claims, 3 Drawing Sheets

DEVICE FOR DISPENSING A WASHING AGENT IN A WASHING MACHINE, PARTICULARLY A DISHWASHER

The present invention relates to a device for dispensing a washing agent in a washing machine, particularly in a dishwasher.

More specifically, the invention relates to a device comprising:

- a body in which is formed an essentially bowl-shaped receptacle having a mouth and intended to receive a quantity of washing agent,
- a cover connected to the body and movable with respect to it between a position in which the mouth of the said receptacle is closed and a position in which the mouth is open, and
- return means tending to move the cover towards the open position.

There are known devices of this type in which the general shape of the cover is essentially rectangular, and the cover is hinged to the body about a fixed axis which extends near one side of the cover. These devices require a considerable amount of free space near the cover to allow the cover to swing between the closed and open positions.

In other known devices, the cover is translated along parallel rectilinear guides between the open position and a position near the closed position, and is then diverted towards the mouth of the receptacle to carry out the actual closing operation. These devices are relatively complicated and expensive.

One object of the invention is to provide an innovative device which makes it possible to reduce the space required for moving the cover between the closed and open positions, and which has a simple and economical structure and is reliable in operation.

This and other objects are achieved according to the invention with a device of the type defined above, characterized in that the cover has a first portion hinged to the body about a first axis which is essentially parallel to the mouth of the receptacle and is translatable along guide means provided in the said body, and a second portion connected to a crank element essentially by hinging about an axis parallel to the first axis; the said crank element being hinged to the body about a third fixed axis, which is parallel to the said first and second axes.

The third axis is conveniently located on the same side of the plane defined by the aforesaid first and second axes as the aforesaid receptacle.

In the device according to the invention, the cover and the associated crank member form a rod and crank system, in other words a crank mechanism of the first kind.

Further characteristics and advantages of the invention will be made clear by the following detailed description, provided purely by way of non-limiting example, with reference to the appended drawings, in which.

Figure 1:
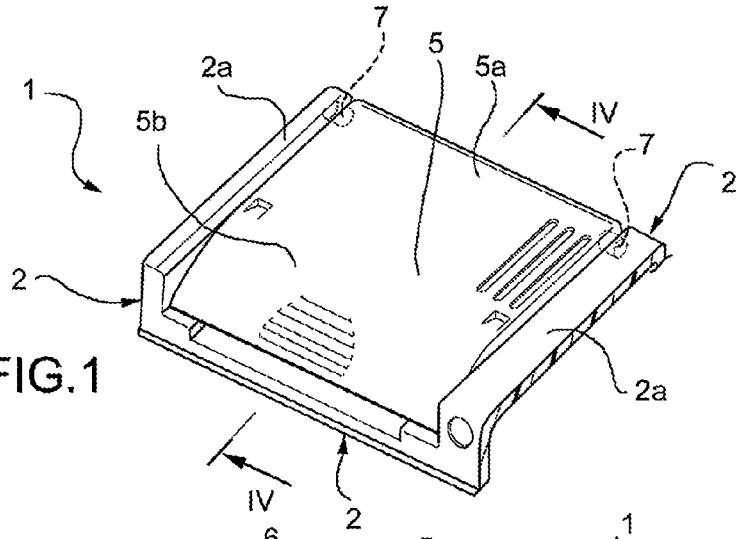
FIG. 1 is a partial perspective view which shows a device according to the present invention with the cover in the closed position.

In the drawings, the number 1 indicates the whole of a device according to the invention for dispensing a washing agent in a washing machine, particularly in a dishwasher.

The device 1 shown in FIGS. 1 to 5 comprises a stationary body 2, made from moulded plastics material for example, intended to be connected (in a known way which is not illustrated), for example, to the inner face of the front door of a dishwasher.

In the body 2 there is formed a hollow receptacle 3, essentially in the form of a bowl, having a mouth indicated by 4. The receptacle 3 is intended to receive a quantity of a washing agent, such as a detergent powder or liquid detergent, or a solid washing agent in the form of a tablet.

The device 1 comprises a cover 5 which is connected to the body 2 and is movable with respect to the latter between a closed position (FIGS. 1 and 4) and an open position (FIGS. 3 and 5) of the mouth 4 of the receptacle 3.

Figure 2:
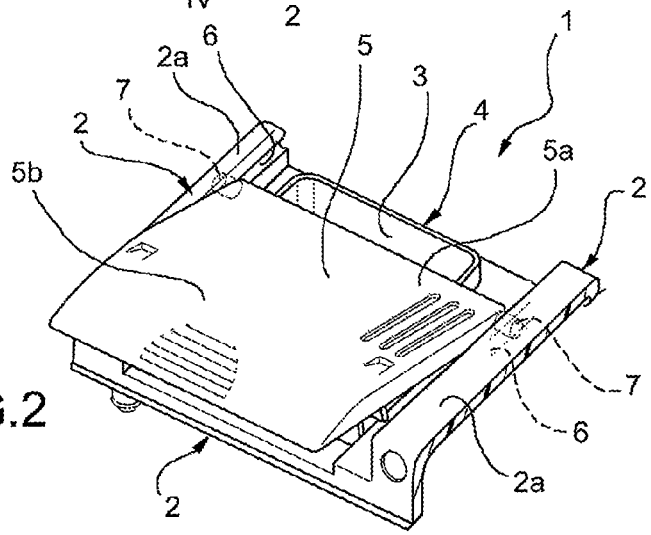
FIG. 2 is a perspective view similar to that of FIG. 1, showing the cover in an intermediate position between the closed and the open positions.
Figure 3:
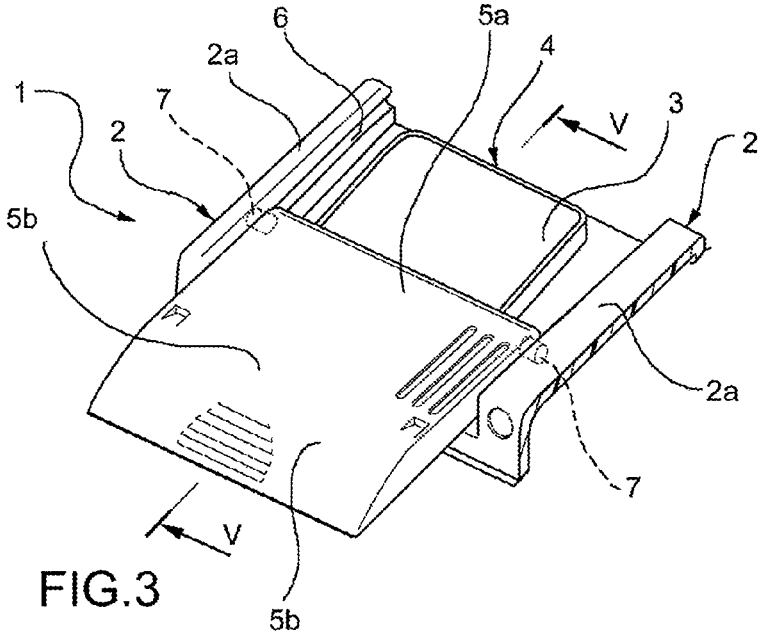
FIG. 3 is a perspective view similar to the preceding ones showing the cover in the open position.

With reference to FIGS. 1 to 3 in particular, in the illustrated example of embodiment, the cover 5 is mounted movably between two facing and parallel shoulders or walls 2*a*, in which there are provided corresponding facing guide grooves 6, which are essentially rectilinear and are close to two opposite sides of the mouth 4 of the receptacle 3.

The cover 5 has a first portion 5*a* provided on opposite sides with corresponding pins 7 which engage slidably in the guide grooves 6 of the body 2. Because of the engagement of these pins 7 in the grooves 6, the cover 5 can swing with respect to the body 2 about a first axis (namely the axis of its pins 7) which is essentially parallel to the mouth 4 of the receptacle 3, and can be translated along the guide grooves 6.

Figure 4:
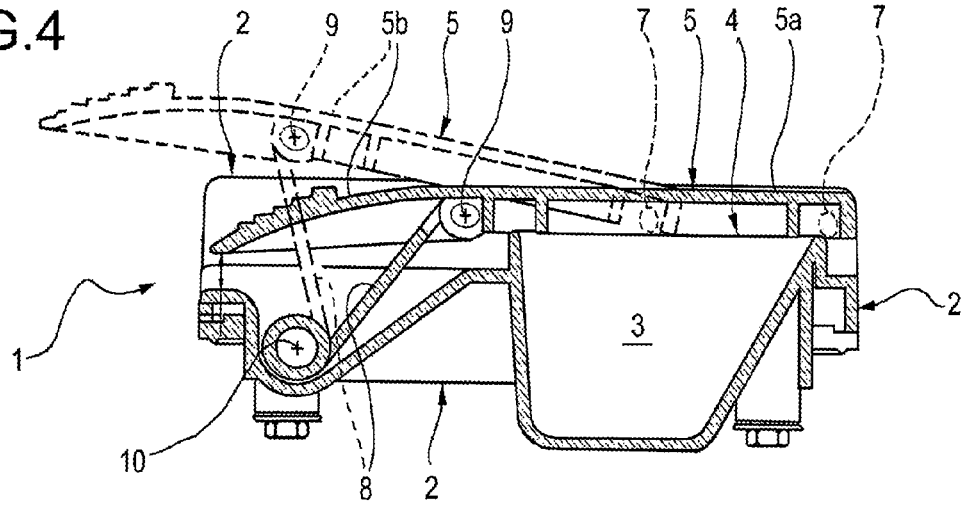
FIGS. 4 and 5 are sectional views taken, respectively, along the line IV-IV of FIG. 1 and the line V-V of FIG. 3.
Figure 5:
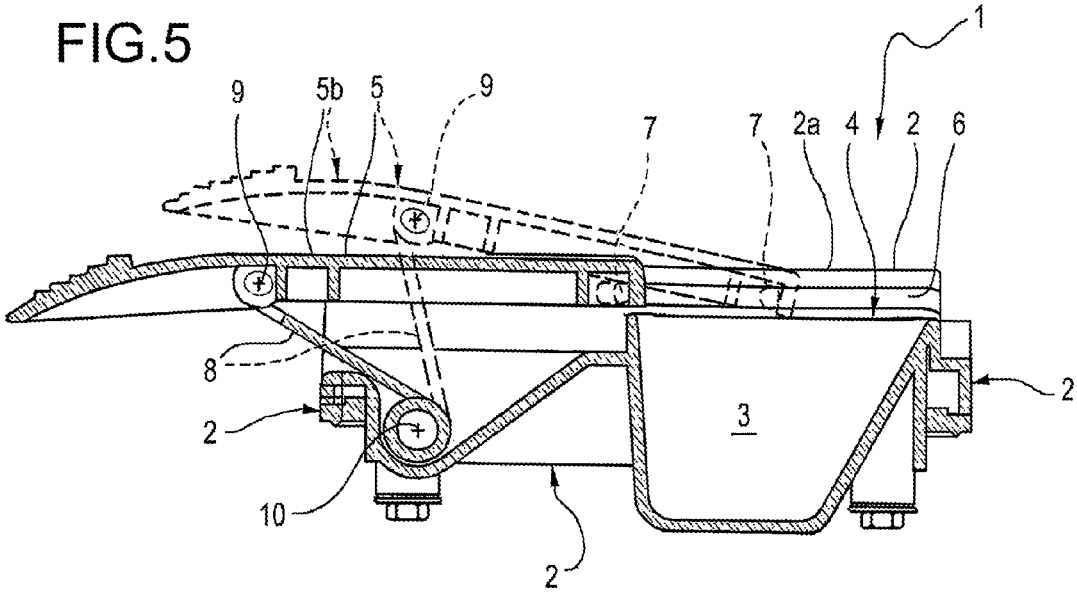

The cover 5 also has a second portion 5*b* which is connected to a crank element 8 (FIGS. 4 and 5) essentially by hinging about a second axis which is indicated by 9 in FIGS. 4 and 5 and is parallel to the axis of the pins 7.

The crank element 8 is, in turn, hinged to the stationary body 2 about a third, fixed axis 10 which is parallel to the axes 7 and 9 described above.

The fixed axis 10 is located on the same side of the plane defined by the axes 7 and 9 as the receptacle 3 for the detergent.

The sequence of FIGS. 1 to 3 shows the movement of the cover 5 from the closed position of the receptacle 3 to the fully open position of the latter. The same sequence can be seen in FIGS. 4 and 5, in which the cover 5 is shown in solid lines in the closed position and in the open position respectively, and is shown in broken lines in an intermediate position.

The combination of the cover 5 and the associated hinged element 8 form a crank mechanism of the first kind, or a rod and crank system. As it moves from the closed to the open position, the cover 5 follows a path along which it projects by a fairly small amount from the plane in which it is located in the closed position and in the open position.

Conveniently, the end portion 5*b* of the cover 5, opposite the portion 5*a*, is conveniently curved and externally convex, so as to limit the transverse projection of this cover in the intermediate positions between the end positions of its operating path.

In a way which is not shown, the crank element 8 is associated with a spring, tending to make it swing towards the position which it assumes when the cover 5 is in the fully open position (FIG. 5). This spring can be, for example, a torsion spring or what is known as a needle spring, mounted around the axis 10.

When the cover 5 is in the closed position (FIG. 4), retaining means (which are of a known type and are not illustrated)

hold it in this position against the action of the return spring which tends to return it to the open position.

During an operating cycle of the machine with which the device 1 is associated, an electrically operated actuator (which is also of a known type and not illustrated), such as a solenoid actuator or other type, causes the retaining means to be disengaged from the cover 5, as a result of which the latter moves from the closed to the open position of the receptacle 3 under the action of the associated return spring.

The cover 5 is moved from the open to the closed position by a user who, after placing a quantity of washing agent in the receptacle 3, makes the cover 5 slide towards the closed position, until it engages with the associated retaining device.

Figure 6:
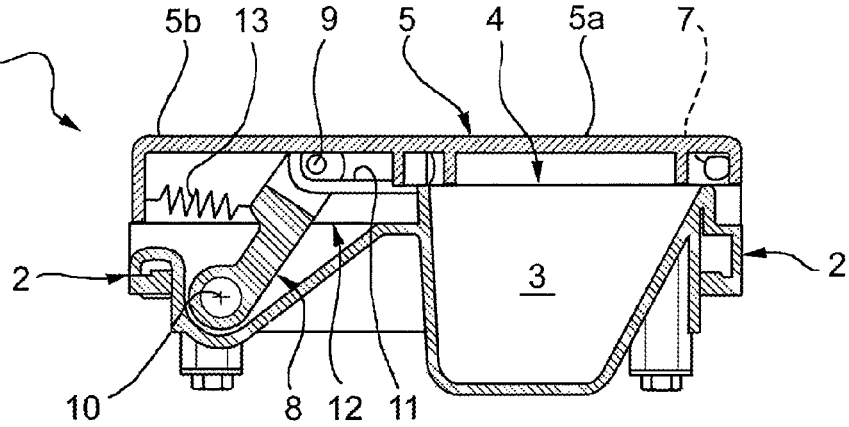
FIGS. 6 to 8 are three sectional views showing a variant embodiment of a device according to the invention in which the cover is shown, respectively, in the closed position, in the intermediate position, and in the position in which the receptacle is fully open for the detergent.
Figure 7:
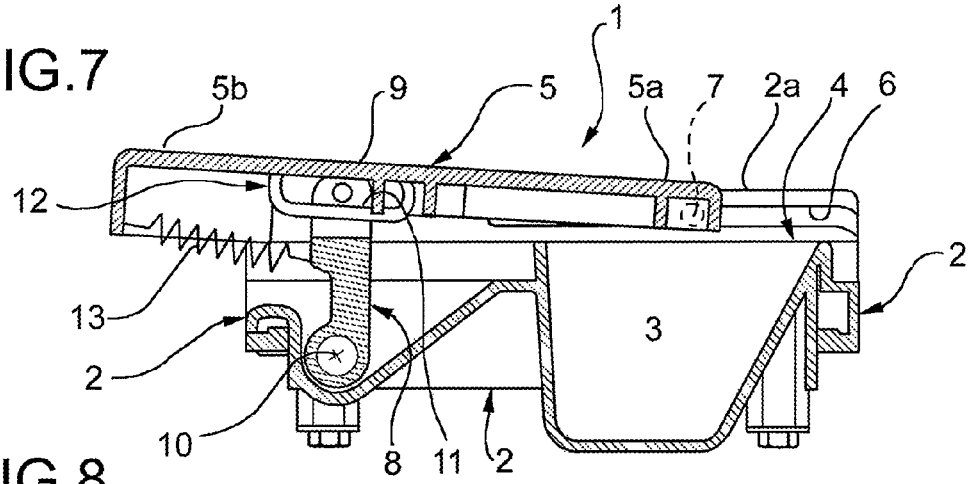
Figure 8:
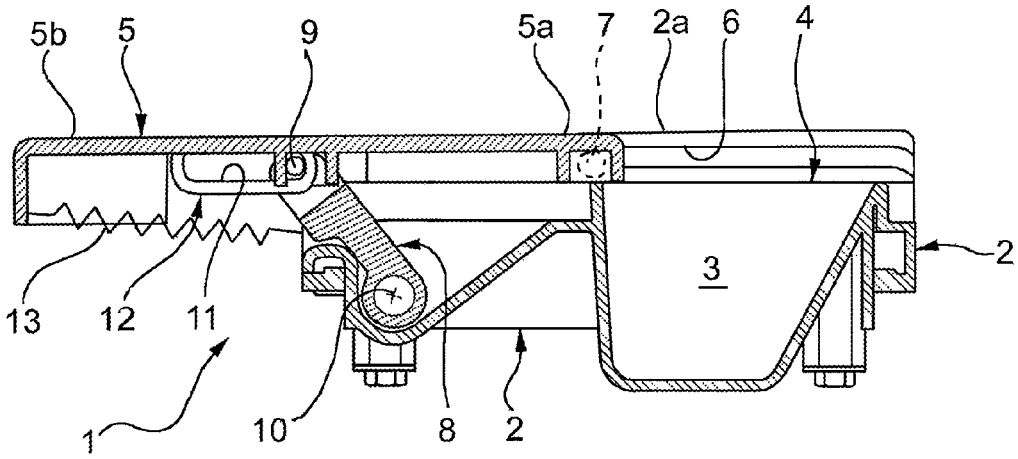

FIGS. 6 to 8 show a variant embodiment which can minimize the extent of the transverse displacement of the cover in its movement from the closed to the open position, while maintaining the same length of the crank member 8, in other words the same distance between the axes 9 and 10. In FIGS. 6 to 8, parts and elements described previously have been given the same reference numerals as those used previously. Whereas, in the embodiments shown in the preceding figures, the hinge axis 9 between the cover 5 and the crank member 8 is essentially fixed with respect to the cover 5, in the embodiment shown in FIGS. 6 to 8 the axis 9 is slidable with respect to the cover 5. The axis 9 is delimited, for example, by a transverse pin fixed to the crank member 8, engaged in an elongate longitudinal slotted aperture 11 formed in an appendage 12 which extends from the lower face of the cover 5.

The arrangement is such that, when the cover 5 is in the position in which the receptacle 3 is closed (FIG. 6), the pin 9 of the crank member 8 is engaged in the proximity of the end of the aperture 11 farthest from the receptacle 3.

In the illustrated embodiment, a resilient element 13, such as a helical spring operating by compression, is positioned between the crank member 8 and the end 5*b* of the cover 5.

When the cover 5 is released from the associated retaining device and the crank member 8 starts to rotate (in the anticlockwise direction with respect to FIGS. 6 and 7) under the action of the corresponding return spring, the resilient member 13 tends to cause a relative movement of the cover 5 (towards the left with respect to FIGS. 6 and 7) with respect to the remote end of the crank member 8. The arrangement is such that, when the crank member 8 has completed its angular travel (FIG. 8), its pin 9 is engaged in the portion of the aperture 11 of the cover 5 nearest to the receptacle 3.

Because of the mechanism described above, when the cover 5 moves from the closed to the open position it is displaced, relative to the body, both by the rotation of the crank member 8 and by its own relative translation with respect to the crank member 8. Thus the extent of the movement of the cover 5 is appreciably greater than in the case in which, given the same distance between the axes 9 and 10, the axis 9 is substantially fixed with respect to the cover 5. The increase in travel of the cover 5 is substantially equal to the length of the slotted aperture 11.

Also, in the embodiments according to FIGS. 6 to 8, the end portion 5*b* of the cover 5 can be curved if necessary, as shown in FIGS. 1 to 5, thus further limiting the extent of the transverse projection of the cover 5 in its travel between the open position and the closed position.

Clearly, provided that the principle of the invention is retained, the forms of application and the details of construction can be varied widely from what has been described and illustrated purely by way of example and without restrictive intent, without thereby departing from the scope of protection of the invention as defined by the attached claims.

The invention claimed is:

1. Device (1) for dispensing a washing agent in a washing machine, particularly in a dishwasher, comprising:

a body (2) in which is formed an essentially bowl-shaped receptacle (3) having a mouth (4) and intended to receive a quantity of washing agent, a cover (5) connected to the body (2) and movable with respect to it between a position in which the mouth (4) of the said receptacle (3) is closed and a position in which the mouth is open, and return means tending to move the cover (5) towards the open position;

the device (1) being characterized in that the cover (5) has a first portion (5*a*) hinged to the body (2) about a first axis (7) which is essentially parallel to the mouth (4) of the receptacle (3) and which is translatable along guide means (6) provided in the said body (2), and a second portion (5*b*) connected to a crank element (8) essentially by hinging about a second axis (9) parallel to the first axis (7); the said crank element (8) being hinged to the body (2) about a third, fixed axis (10) which is parallel to the said first and second axes (7, 9).

2. Device according to claim 1, in which the aforesaid third axis (10) is located on the same side of the plane defined by the first and second axes (7, 9) as the said receptacle (3).

3. Device according to claim 1, in which the said second portion (5*b*) of the cover (5) is curved and externally convex.

4. Device according to claim 1, in which the said second axis (9) is fixed with respect to the cover (5).

5. Device according to claim 1, in which the said second axis (9) is movable longitudinally with respect to the cover (5); resilient means (13) being provided which tend to cause a displacement of the cover (5) relative to the crank member (8) in the direction away from the said receptacle (3).

* * * * *